US010264842B2

(12) United States Patent
Huh

(10) Patent No.: US 10,264,842 B2
(45) Date of Patent: Apr. 23, 2019

(54) COUPLING STRUCTURE OF REPLACEABLE VISOR HINGE FOR HEADBAND

(71) Applicant: OTOS WING CO., LTD., Seoul (KR)

(72) Inventor: Moon Young Huh, Seoul (KR)

(73) Assignee: OTOS WING CO., LTD., Seoul (KR)

( * ) Notice: Subject to any disclaimer, the term of this patent is extended or adjusted under 35 U.S.C. 154(b) by 1407 days.

(21) Appl. No.: 14/027,859

(22) Filed: Sep. 16, 2013

(65) Prior Publication Data

US 2015/0074877 A1 Mar. 19, 2015

(51) Int. Cl.
*A42B 3/22* (2006.01)

(52) U.S. Cl.
CPC ..... *A42B 3/222* (2013.01); *A42B 3/225* (2013.01)

(58) Field of Classification Search
CPC ..... A42B 3/04; A42B 3/0406; A42B 3/042; A42B 3/185; A42B 3/20; A42B 3/221; A42B 3/326; A42B 3/003; A42B 3/18; A42B 3/30; A42B 3/222; A42B 3/225; A42B 3/044; A42B 3/0473; A42B 3/223; A42B 3/227; A42B 1/18; A42B 3/046; A42B 1/24; A42B 1/244; A42B 1/067; A42B 3/0426; A42B 3/0433; A42B 3/06
USPC ..... 2/422, 424, 8.2, 426, 8
See application file for complete search history.

(56) References Cited

U.S. PATENT DOCUMENTS

| | | | | |
|---|---|---|---|---|
| 1,885,426 | A * | 11/1932 | Flood | A61F 9/06 2/8.2 |
| 6,260,197 | B1 * | 7/2001 | Hoogewind | A61F 9/061 2/8.3 |
| 7,865,968 | B2 * | 1/2011 | Lilenthal | A42B 3/225 2/8.2 |
| 2006/0080761 | A1 * | 4/2006 | Huh | A42B 3/04 2/424 |
| 2012/0144567 | A1 * | 6/2012 | Huh | A42B 3/14 2/424 |

* cited by examiner

*Primary Examiner* — Alissa J Tompkins
*Assistant Examiner* — Catherine M Ferreira
(74) *Attorney, Agent, or Firm* — Cantor Colburn LLP

(57) ABSTRACT

Provided is a coupling structure of a visor hinge for a headband to connect a protective mask, which is configured to cover the wearer's face along with a viewing window, to both sides of a headband which assists the wearer in wearing the protective mask. The coupling structure includes base molds protruding from both sides of the headband, a slider located outward of each of the base molds, a button located outward of the slider, a stopper located outward of the button, and a hinge located outward of the stopper. Accordingly, it may be possible to easily adjust an angle and a distance of the protective mask with respect to the headband using the hinge, and the welding mask may be used more conveniently.

4 Claims, 12 Drawing Sheets

COUPLING STRUCTURE OF REPLACEABLE VISOR HINGE FOR HEADBAND

BACKGROUND OF THE INVENTION

Field of the Invention

The present invention relates to a coupling structure of a replaceable visor hinge for a headband, in which a protective mask constituting a visor (a face mask, a face shield, or a welding mask) is axially coupled to left and right ends of a headband.

Description of the Related Art

In general, welding generates an intense flash of light and causes a welding material to scatter toward the worker's face due to sudden increase in heat and resistance generated during welding. A welding mask is used as a representative example of equipment for protecting the worker's eyes and face from the above-mentioned dangers.

A conventional welding mask generally includes a protective mask configured to cover the worker's face along with a viewing window, and a headband for assisting the worker in wearing the protective mask on the head. Both ends of the head band are coupled to opposite sides of the protective mask using hinges. Thus, in a state in which the headband is worn on the worker's head, the protective mask may be pivoted about the hinges between the front of the face and the top of the head.

As an example of the coupling structure of the above-mentioned hinge, U.S. Pat. (3M) No. 7,865,968 discloses that the angle of a protective mask may be adjusted using a hinge and the distance of the protective mask from a headband may be adjusted. In detail, slide channels are formed at both sides of the headband, a plurality of holes is formed between the slide channels, a tab having a protrusion is integrally formed at one side of a slide attachment configured to move along the slide channels such that the protrusion of the tab may be inserted into or withdrawn from each hole, and the slide attachment is coupled with the hinge.

However, according to these conventional configurations, there is a problem in that after the tab is first pulled and withdrawn from the hole by fingertips, the tab is again pushed at a proper distance and the protrusion of the tab is inserted into the hole, in order to adjust the distance of the protective mask. In other words, there is inconvenience of having to catch and pull the tab such that the tab is withdrawn outward, and there is inconvenience in that coupling between the tab and the hole is completed by pushing the tab after the protrusion of the tab is exactly adjusted to the hole.

SUMMARY OF THE INVENTION

Therefore, the present invention has been made in view of the above problems, and it is an object of the present invention to provide a coupling structure of a replaceable or functionally movable hinge for a headband, capable of allowing easy adjustment of an angle and a distance of a protective mask with respect to a headband.

It is another object of the present invention to provide a coupling structure of a visor hinge for a headband, in which a stopper is moved by a lever (seesaw) action generated by pushing a push plate so as to be fixed to a rail or be moved.

In accordance with the present invention, the above and other objects can be accomplished by the provision of a coupling structure of a visor hinge for a headband, to connect a protective mask, which is configured to cover the wearer's face along with a viewing window, to both sides of a headband which assists the wearer in wearing the protective mask, the coupling structure of a visor hinge for a headband including rail base portions protruding from both sides of the headband, a plurality of distance adjustment recesses for adjusting a distance in a forward or rearward direction being formed at regular intervals on an outer surface of each of the protruded rail base portions, rails being formed on upper and lower surfaces of the protruded rail base portion, a slider located outward of the rail base portion, the slider being coupled to the rail base portion so as to enclose the upper and lower rails and moving in the forward or rearward direction, the slider being formed with an entry port which communicates with an associated one of the distance adjustment recesses, a push plate located outward of the slider, the push plate being configured such that force due to a seesaw action generated by simultaneously pushing the push plate with fingers at upper and lower portions of the slider acts on the push plate, a stopper located outward of the push plate, the stopper accessing the associated distance adjustment recess through the entry port, the stopper being formed with a bent portion lengthened in forward and rearward directions thereof to be supported by front and rear sides of the slider, and a hinge which is located outward of the stopper and is axially coupled to the protective mask in a state of being coupled to front and rear ends of the slider.

A connection portion of the push plate may be configured to be bent in a wrinkle form extending in upward and downward directions.

The hinge may include a fixed body which has a bolt at a center thereof while being coupled to the slider, a rotation body which passes through the protective mask to be fixedly coupled to an inner side thereof while rotating in a state of being axially coupled to the bolt of the fixed body, a washer in which the bolt is fitted by passing through a center of the washer, the washer being key-coupled to the rotation body at an outer side of the protective mask, and a knob which has a nut at a center thereof such that the bolt passes through and is fastened to the nut.

The rotation body may include a male portion in which an auxiliary stopper protrudes on an extended lever at one side of the male portion, and a female portion which passes through the protective mask to be fixedly coupled to the inner side thereof while being formed, at one side thereof, with a plurality of angle adjustment holes such that the auxiliary stopper is fitted in an associated one of the angle adjustment holes during rotation.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
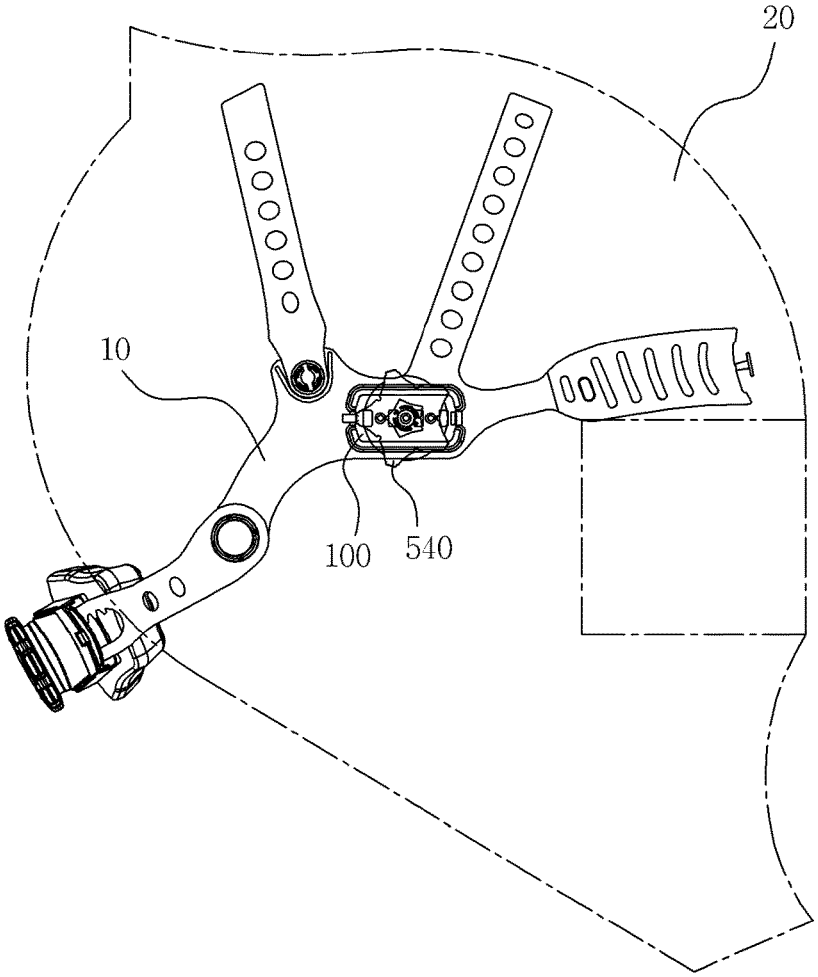
FIG. 1 is a side view illustrating a welding mask to which the present invention is applied.
Figure 2:
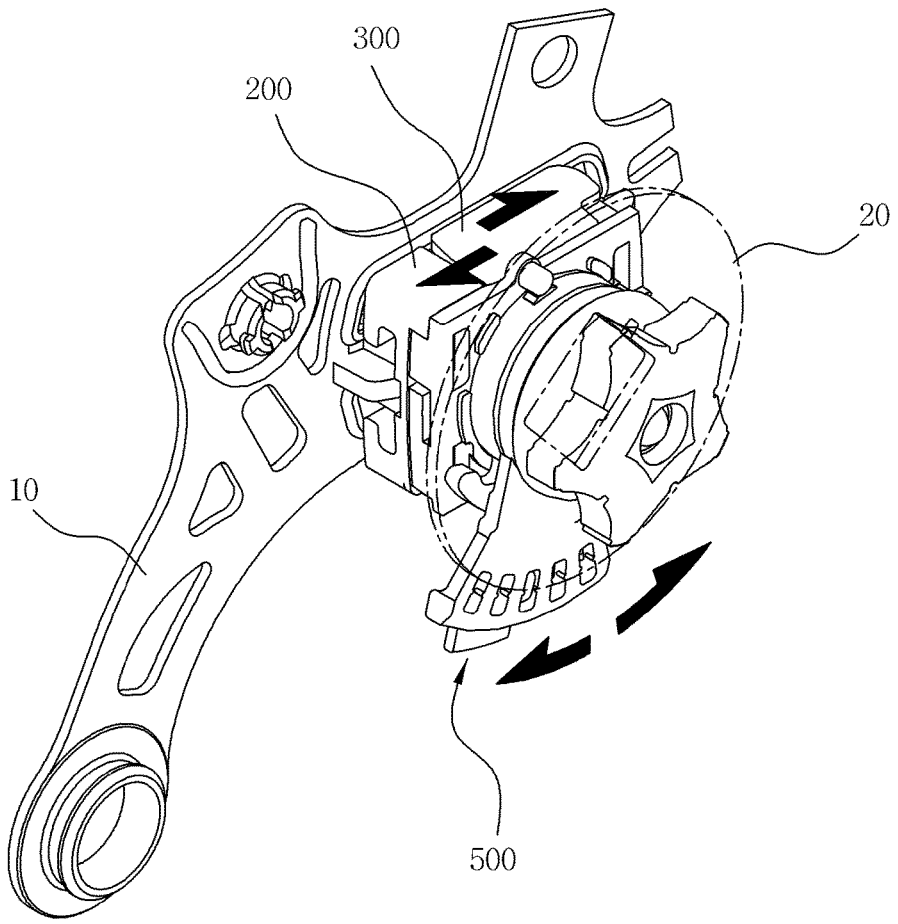
FIG. 2 is a coupled perspective view of main parts in a coupling structure of a hinge for a welding mask to which the present invention is applied.

Reference will now be made in detail to the preferred embodiment of the present invention with reference to the attached drawings.

Although a "head gear (band)" shown in FIGS. 1 to 12 includes a helmet, particularly a welding helmet, the present invention is not limited thereto. In addition, although a "visor" includes a face mask, a face shield, etc., the present invention is not limited thereto. For example, the visor means any one of various devices which may be used to protect the wear's head, face, neck, or the like.

As shown in FIGS. 1 to 12, a coupling structure of a hinge for a welding mask according to the present invention includes rail base portions 100 protruding from both sides of a headband 10, a slider 200 located outward of each of the rail base portions 100, a push plate 300 located outward of the slider 200, a stopper 400 located outward of the push plate 300, and a hinge 500 located outward of the stopper 400.

Figure 3:
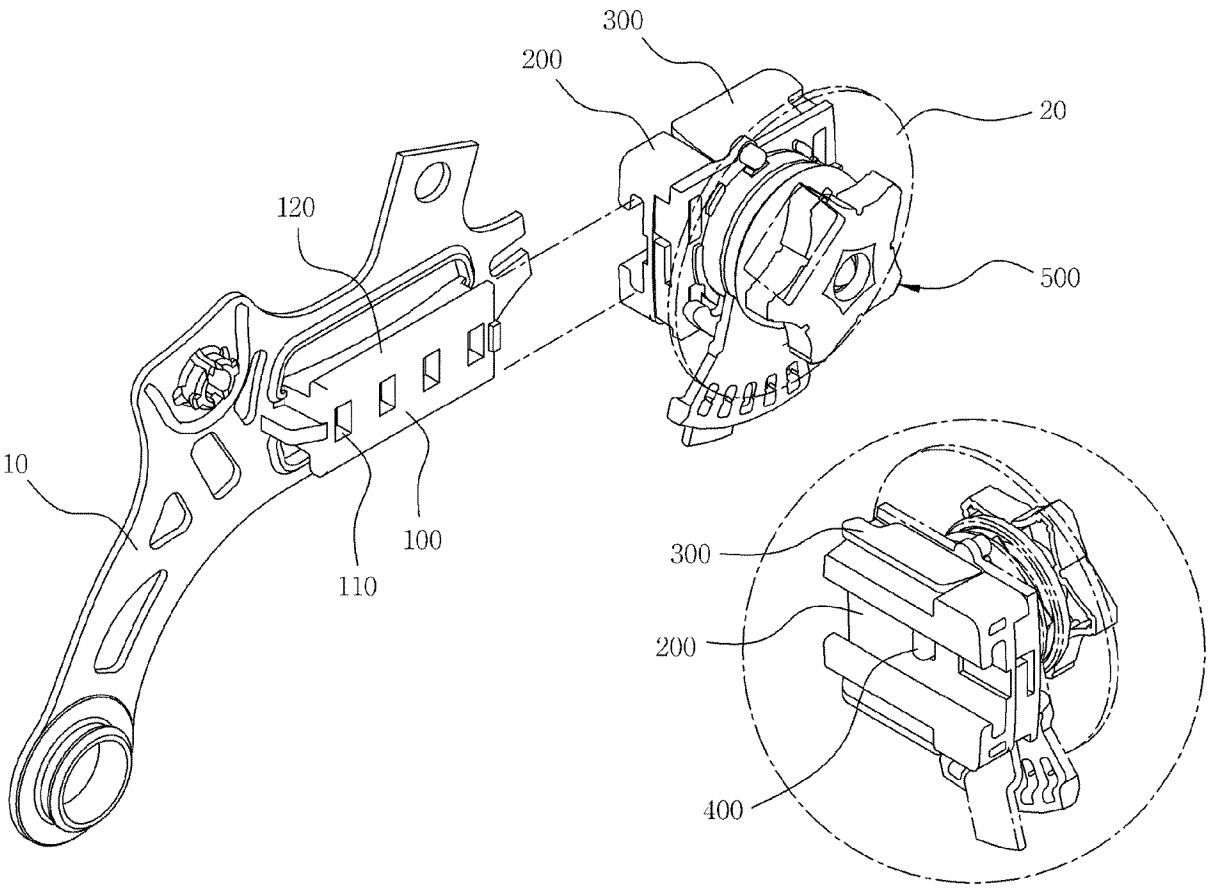
FIG. 3 is an exploded perspective view of a base mold and a slider in the coupling structure of a hinge for a welding mask to which the present invention is applied.

Accordingly, according to the coupling structure of a hinge of the present invention, the slider 200 is moved forward or rearward by a predetermined distance along the rail base portion 100, as shown in FIG. 3. As a result, it may be possible to easily adjust a distance between the wearer's face and a protective mask 20, and further the protective mask 20 may be pivoted upward or downward with respect to the headband 10 using the hinge 500.

Referring to FIG. 3, the rail base portions 100 protrude from both sides of the headband 10. A plurality of distance adjustment recesses 110 for adjusting a distance in a forward or rearward direction is formed at regular intervals on an outer surface of each of the protruded rail base portions 100, and rails 120 are formed on upper and lower surfaces of the protruded rail base portion 100.

The sliders 200 are located outward of the respective rail base portions 100. Each of the sliders 200 is slidably coupled to the rail base portion 100 so as to enclose the upper and lower rails 120 and moves in the forward or rearward direction. The slider 200 is formed with an entry port 210 communicating with an associated one of the distance adjustment recesses 110. In this case, an outside central portion of the slider 200 is formed with a groove in which the push plate 300 and the stopper 400 to be described later are received, and the stopper 400 is supported by front and rear sides of the slider while the hinge 500 to be described later is coupled to the groove.

Figure 4:
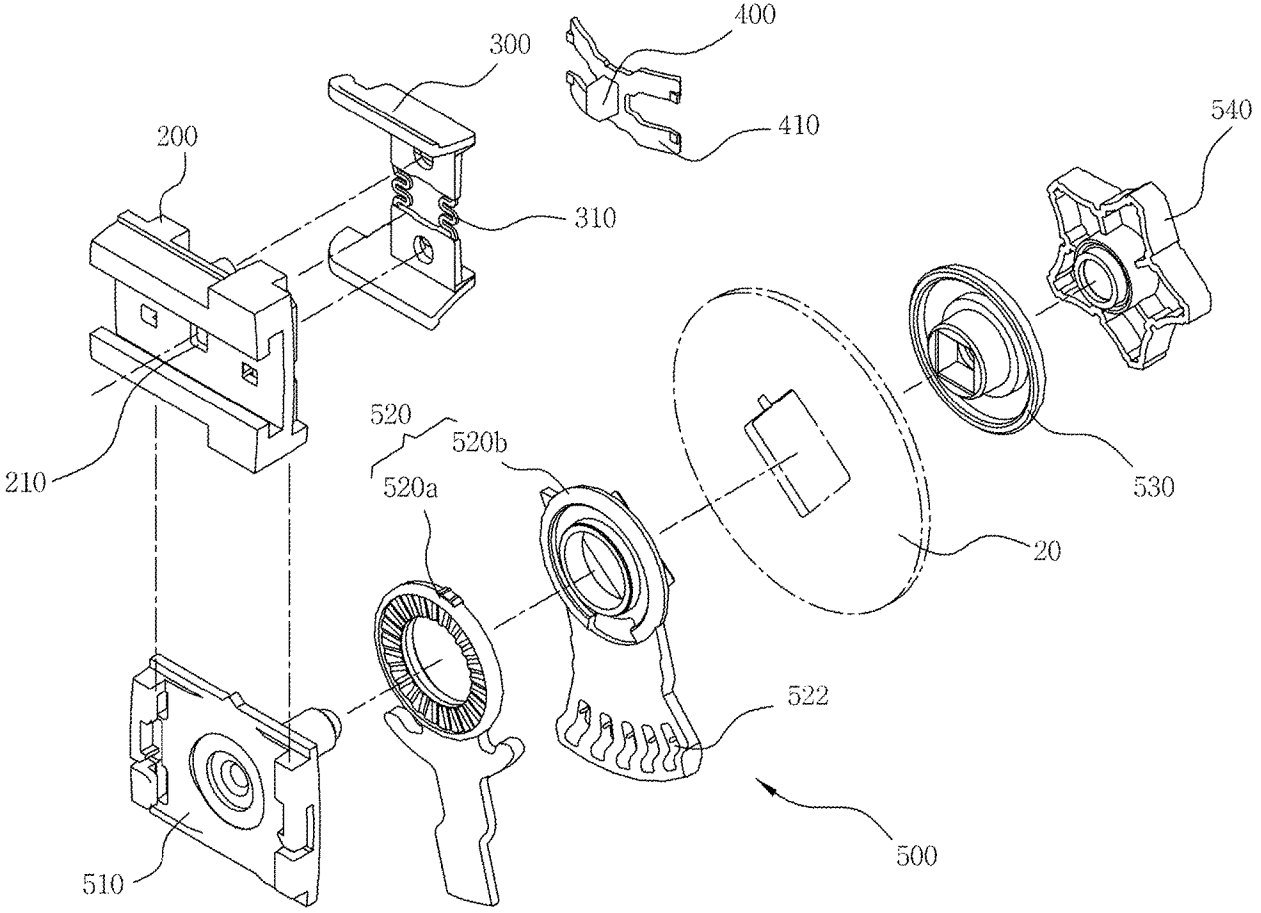
FIGS. 4 and 5 are exploded perspective views illustrating the coupling structure of a hinge for a welding mask to which the present invention is applied.
Figure 8:
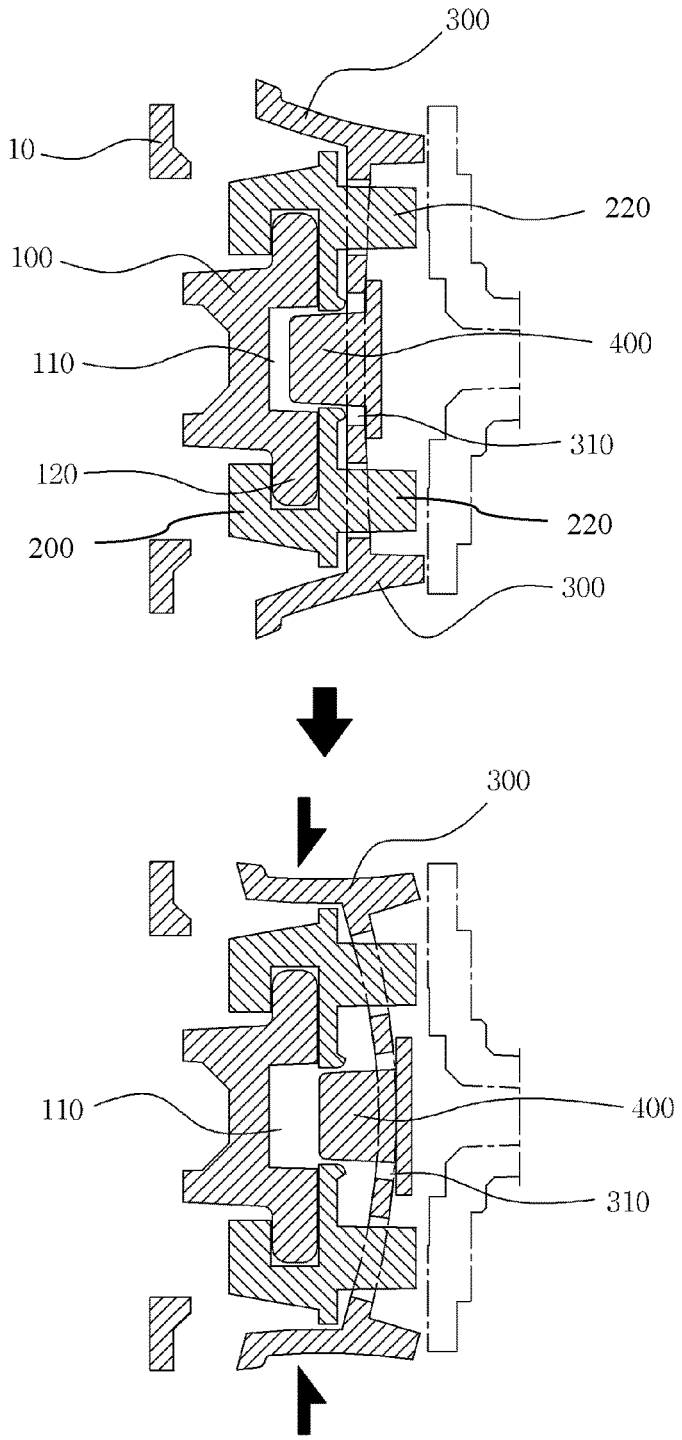
FIGS. 8 and 9 are cross-sectional views illustrating an action in the coupling structure of a hinge for a welding mask to which the present invention is applied.

As shown in FIGS. 4 and 8, the push plate 300 is located outward of the slider 200, and configured to be pushed simultaneously with fingers at upper and lower portions of the slider 200.

Figure 5:
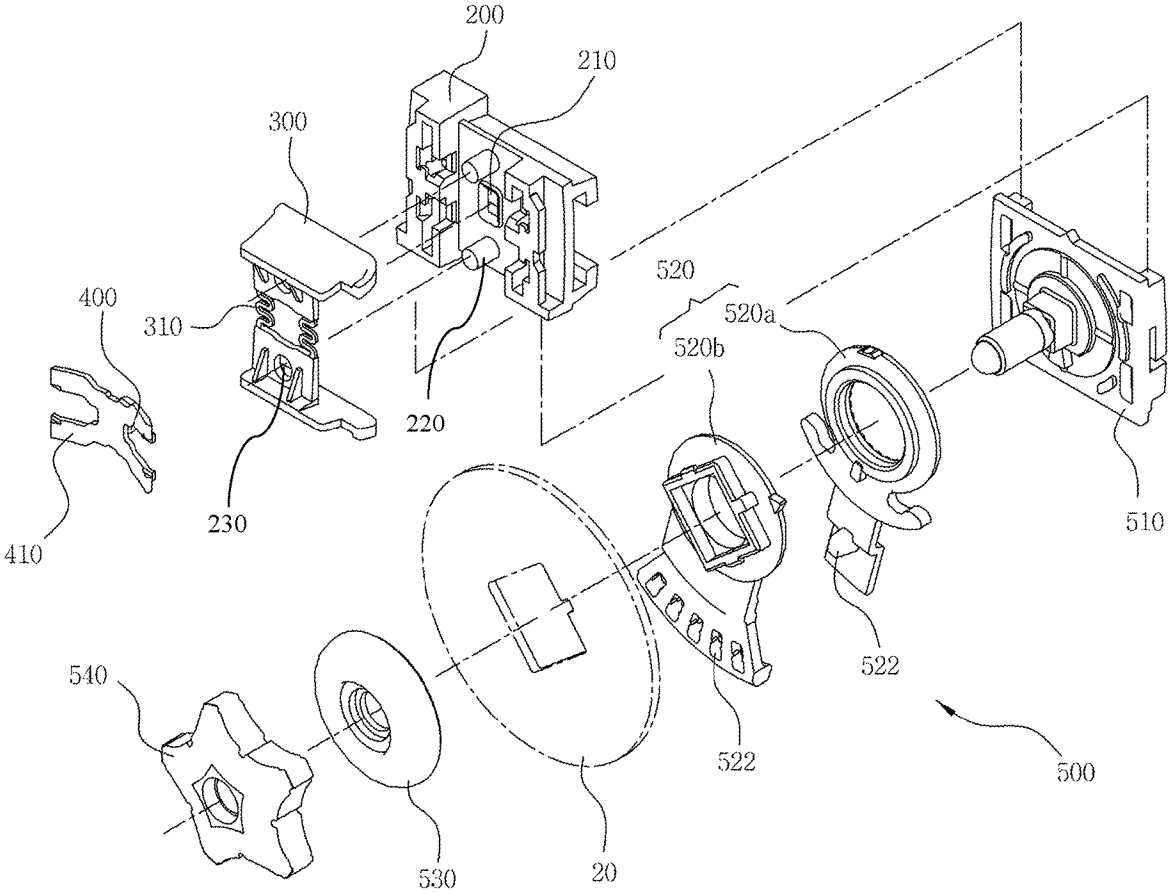

In addition, referring to FIG. 5, when the push plate is configured of an upper push plate and a lower push plate and the upper and lower push plates may be individually operated, the upper and lower push plates are configured to be lifted due to a seesaw action by forming a through hole 230 in which a shaft portion 220 formed at the upper portion of the slider is fitted. As described above, the upper and lower push plates may be individually mounted, but are preferably formed with a connection portion 310 therebetween for convenience of assembly.

In addition, the connection portion 310 connected through the entry port 210 is configured to be bent, namely in the form of being curved upward or downward as shown in FIGS. 4 and 8, when the upper and lower push plates are pushed. The connection portion 310 is normally formed upright, and serves to push the stopper 400 to be described later toward the outside while being bent when the push plate 300 is pushed.

In this case, as shown in FIG. 8, the connection portion 310 is configured to be bent in a wrinkle form so as to push the stopper 400 while performing a seesaw action in the upward or downward direction when the push plate is pushed.

Figure 9:
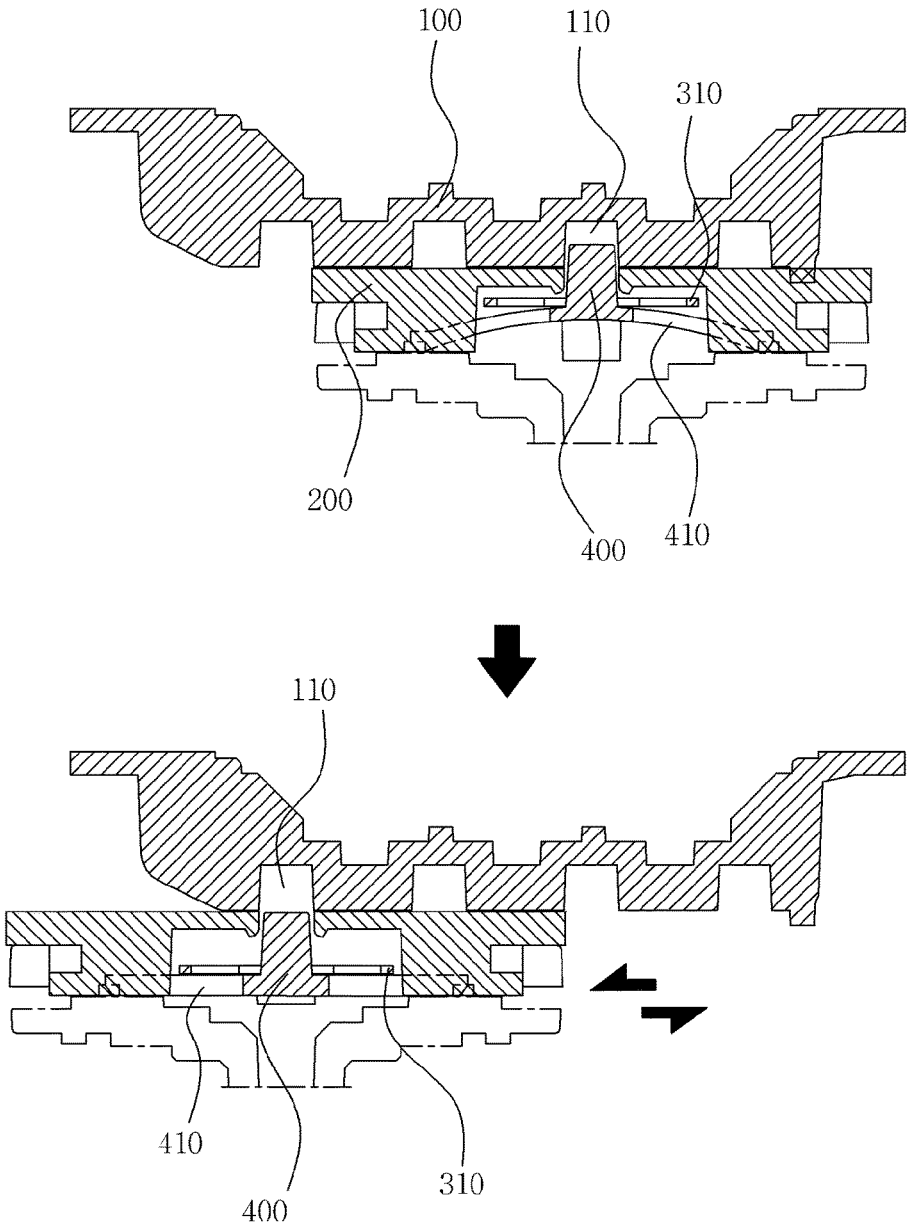
Figure 10:
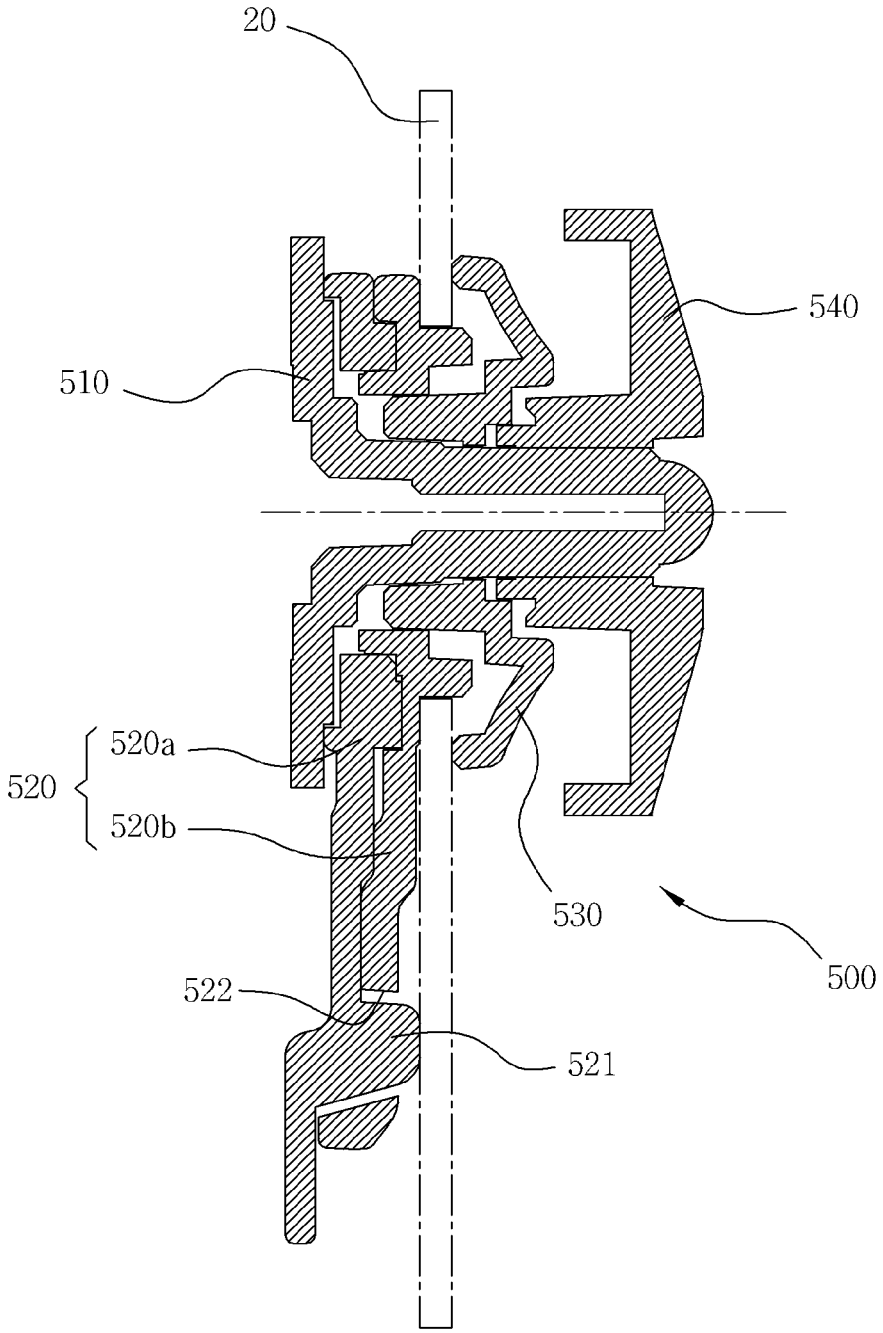
FIGS. 10 and 11 are cross-sectional views illustrating a hinge action in the coupling structure of a hinge for a welding mask to which the present invention is applied.
Figure 11:
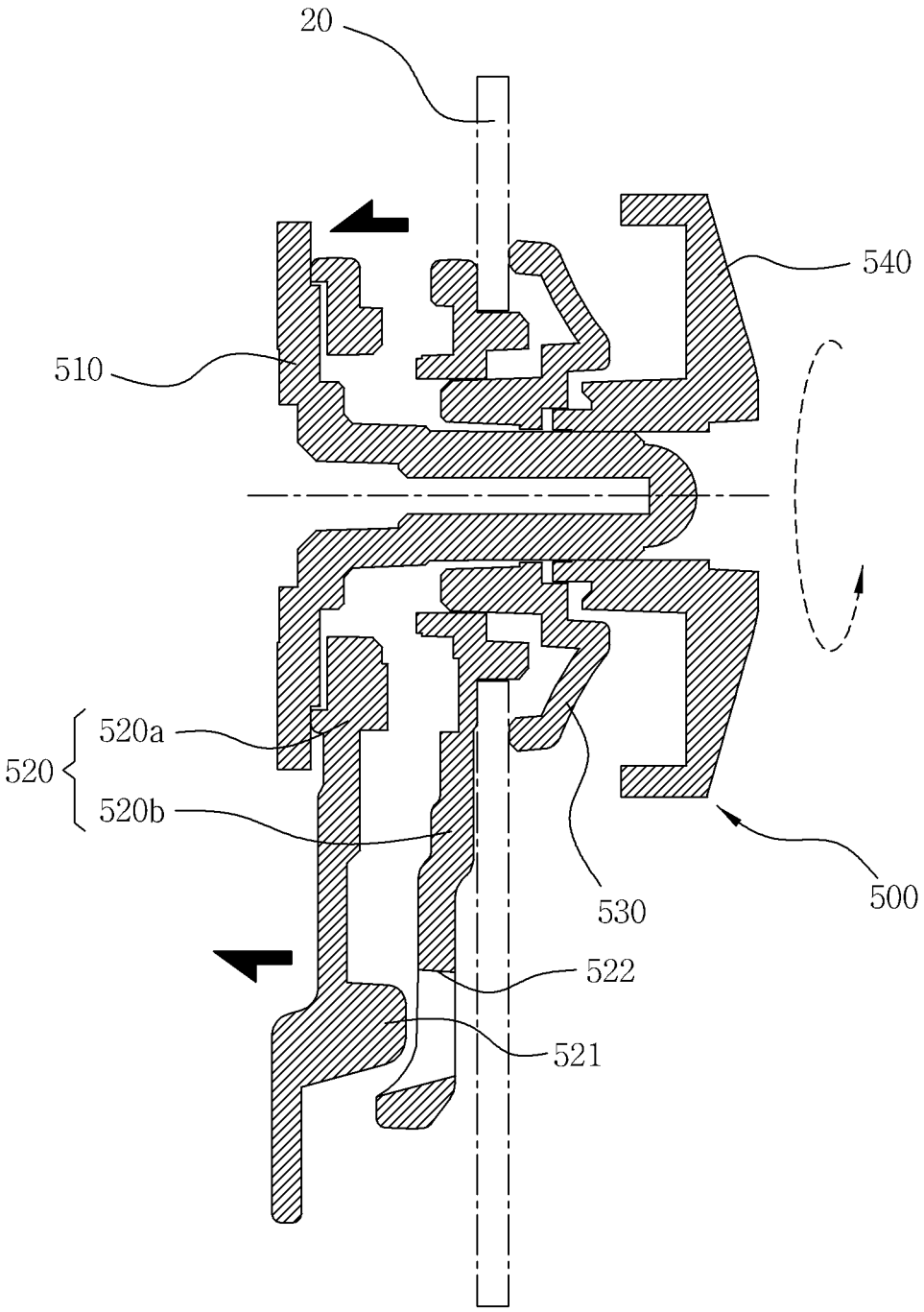
Figure 12:
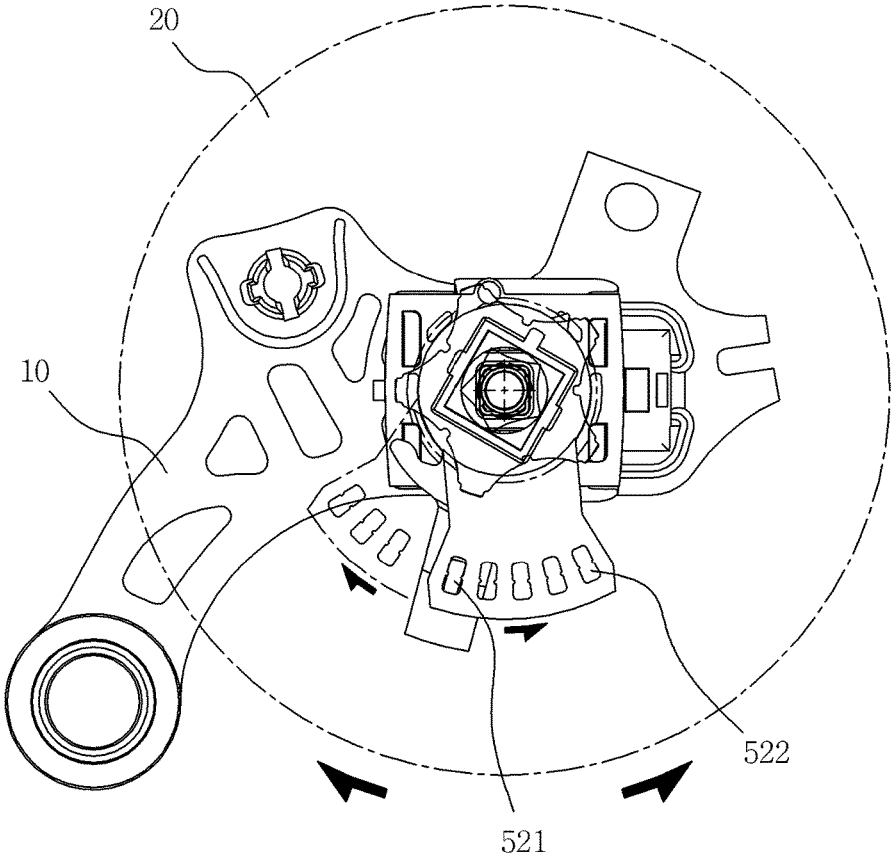
FIG. 12 is a side view illustrating the hinge action in the coupling structure of a hinge for a welding mask to which the present invention is applied.

As shown in FIGS. 4 and 5, the stopper 400 is located outward of the push plate 300 and accesses the associated distance adjustment recess 110 through the entry port 210. The stopper 400 is formed with a bent portion 410 lengthened in forward and rearward directions thereof, and is supported by the front and rear sides of the slider 200. In this case, the bent portion 410 takes the form of a convex plate spring in an entry port direction. Accordingly, as shown in FIG. 9, in a state in which the bent portion 410 is supported by the front and rear sides of the slider 200, the protective mask does not deviate from the adjusted position since the stopper 400 is fitted in the associated distance adjustment recess 110 through the entry port 210 when the push plate 300 is not pushed, whereas the position of the protective mask may be adjusted since the stopper 400 is decoupled from the distance adjustment recess 110 when the connection portion 310 is bent by pushing the push plate 300.

Figure 6:
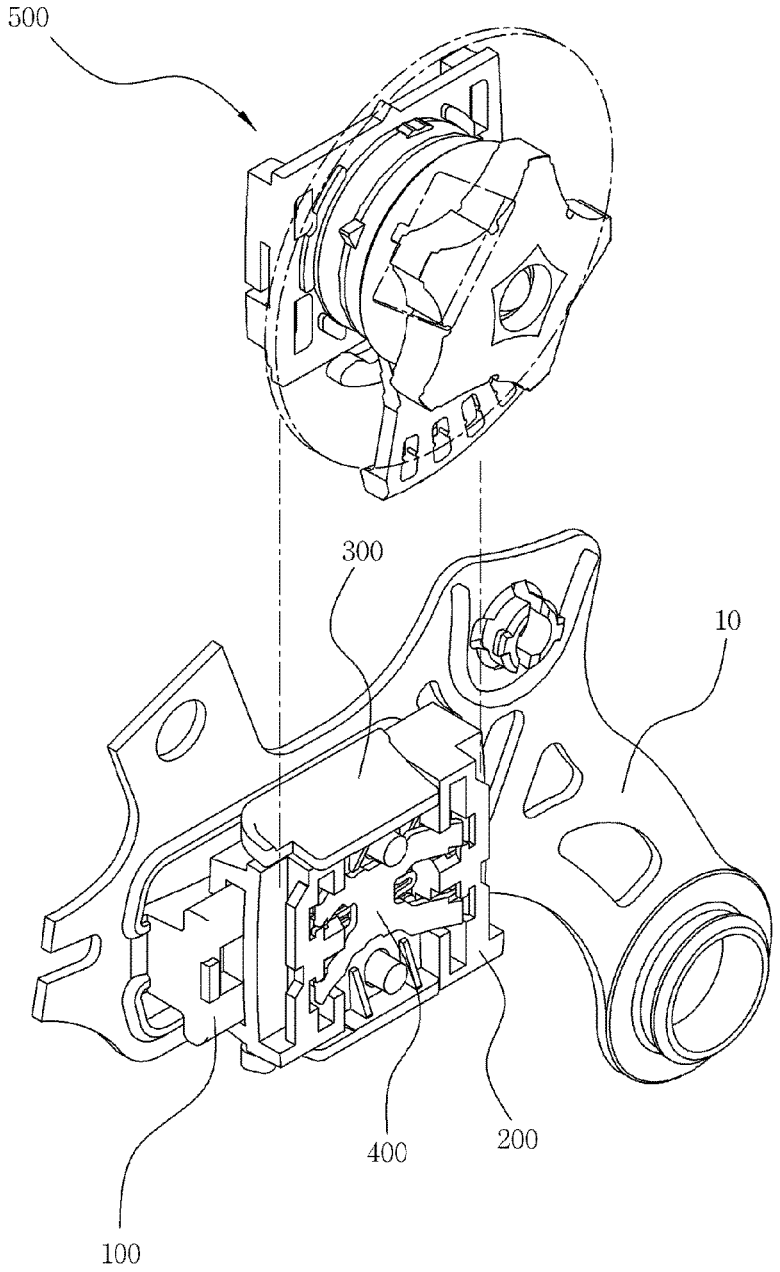
FIG. 6 is an exploded perspective view of a slider and a hinge in the coupling structure of a hinge for a welding mask to which the present invention is applied.
Figure 7:
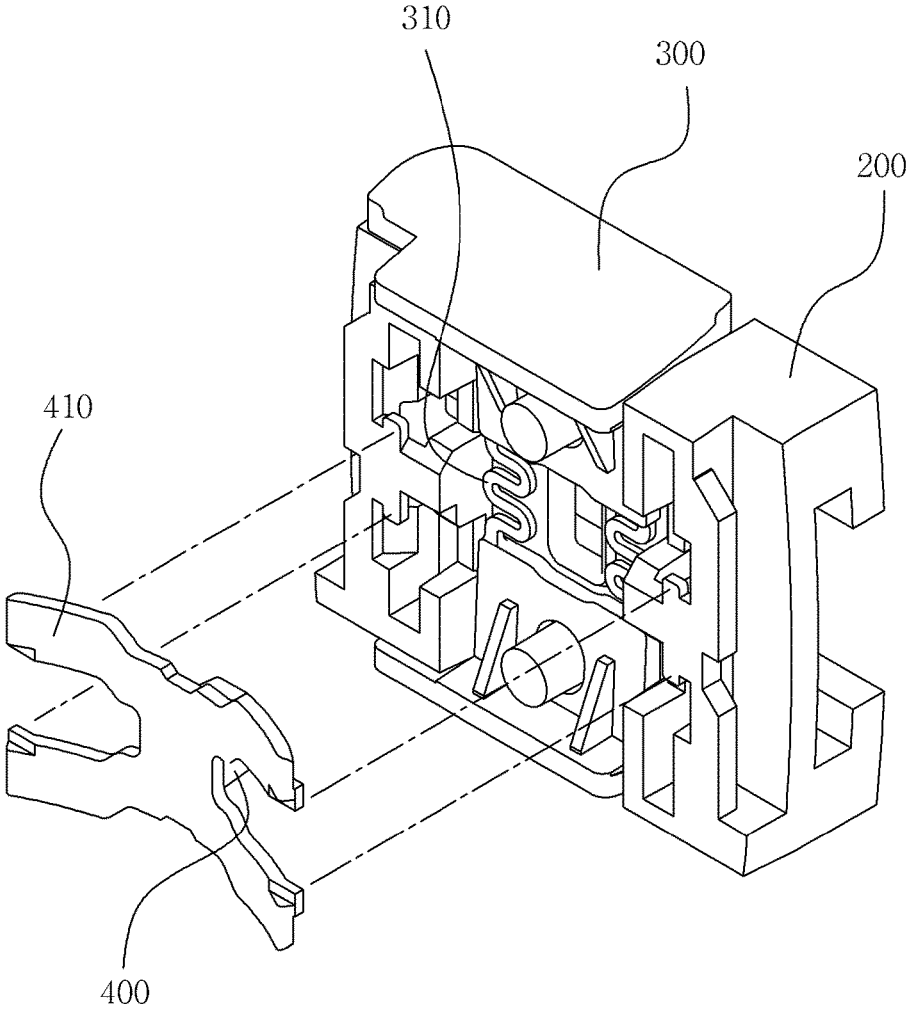
FIG. 7 is an exploded perspective view illustrating a state in which the slider is decoupled from a stopper in the coupling structure of a hinge for a welding mask to which the present invention is applied.

Referring to FIG. 6, the hinge 500 is located outward of the stopper 400. The hinge 500 is axially coupled to the protective mask in a state of being coupled to front and rear ends of the slider 200. Accordingly, the protective mask 20 coupled to the hinge 500 may be freely rotated by a desire angle with respect to the headband 10.

Meanwhile, as an example, as shown in FIGS. 4, 5 and 10 to 12, the hinge 500 may include a fixed body 510 which has a bolt at a center thereof while being coupled to the slider, a rotation body 520 which passes through the protective mask 20 to be fixedly coupled to an inner side thereof while rotating in a state of being axially coupled to the bolt of the fixed body 510, a washer 530 in which the bolt is fitted by passing through a center of the washer while the washer 530 is key-coupled to the rotation body 520 at an outer side of the protective mask 20, and a knob 540 which has a nut at a center thereof such that the bolt passes through and is fastened to the nut. Accordingly, when the rotation body 520 is pressed against the fixed body 510 by tightening the knob 540, the protective mask 20 through which the rotation body 20 passes and is coupled is not rotated. When the rotation body 520 is decoupled from the fixed body 510 by releasing the knob 540, the protective mask 20 through which the rotation body 20 passes and is coupled may be pivoted upward or downward.

Meanwhile, in order to prevent the fixed body 510 and the rotation body 520 from sliding and rotating relative to each other due to weight of the protective mask 20 in a state in which the fixed body 510 is pressed against the rotation body 520, a rotation prevention protrusion and a corresponding rotation prevention groove for preventing rotation through engagement therebetween are respectively formed at contact surfaces between the fixed body 510 and the rotation body 520.

In addition, as an example, the rotation body 520 includes a male portion 520*a* in which an auxiliary stopper 521 protrudes on an extended lever at one side of the male portion, and a female portion 520*b* which passes through the protective mask 20 to be fixedly coupled to the inner side thereof while being formed, at one side thereof, with a plurality of angle adjustment holes 522 such that the auxiliary stopper 521 is fitted in an associated one of the angle adjustment holes 522 during rotation. As such, the rotation body 520 is configured of the male portion 520*a* formed with the auxiliary stopper 521 and the female portion 520*b* formed with the angle adjustment holes 522, thereby enabling the rotation angle of the protective mask 20 to be further adjusted using the male portion 520*a* and the female portion 520*b*. For example, in a case in which a position of a protective window does not coincide with a position of the wearer's eyes or the protective mask 20 does not fully cover the wearer's face when the protective mask 20 is fully dropped by releasing the knob 540 in a state in which the auxiliary stopper 521 is fitted in the first angle adjustment hole 522, the wearer farther drops the protective mask 20 and wears the protective mask 20 by pulling the lever of the male portion 520*a* and moving the auxiliary stopper 521 to the second angle adjustment hole 522. In contrast, when the protective mask 20 is overly dropped, the rotation angle of the protective mask 20 may be adjusted and be easily worn in a similar manner.

In accordance with the configurations of the present invention, it may be possible to easily adjust the angle and the distance of the protective mask 20 with respect to the headband 10 using the hinge. Consequently, the welding mask may be used more conveniently.

As is apparent from the above description, in accordance with a coupling structure of a replaceable visor hinge for a headband, it may be possible to easily adjust an angle and a distance of a protective mask with respect to a headband using a hinge. Consequently, a worker may more conveniently utilize a welding mask.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A coupling structure of a visor hinge for a headband, to connect a protective mask, which is configured to cover a wearer's face along with a viewing window, to both sides of the headband which assists a wearer in wearing the protective mask, the coupling structure of a visor hinge for a headband comprising:

a rail base portion protruding from a headband;

a plurality of distance adjustment recesses formed at regular intervals in a longitudinal direction on an outer surface of the rail base portion;

rails formed on upper and lower surfaces of the rail base portion;

a slider slidably installed on the rails, the slider enclosing the rails and moving in forward or rearward direction on the rails;

an entry port formed in the slider, the entry port corresponding to the distance adjustment recesses;

a push plate installed outward of the slider, the push plate having a through-hole in a center thereof and being configured to forcibly move away from the slider when upper and lower portions of the push plate are pressed by the wearer;

a stopper installed physically separately from and outward of the push plate, the stopper inserted into one of the distance adjustment recesses through the entry port and the through-hole, the stopper being formed with a bent portion lengthened in forward and rearward directions thereof to be elastically supported by front and rear sides of the slider, the stopper being configured to move away from the one of the distance adjustment recesses when the push plate forcibly moves away from the slider; and a hinge installed outward of the stopper and the protective mask being pivoted on the hinge.

2. The coupling structure of a visor hinge for a headband according to claim 1, wherein the push plate includes an upper portion, a lower portion and a connection portion in-between, and the connection portion includes a wrinkle to provide elasticity thereto.

3. The coupling structure of a visor hinge for a headband according to claim 1, wherein the hinge comprises:

a fixed body which has a bolt at a center thereof while being coupled to the slider;

a rotation body which passes through the protective mask to be rotatably coupled to an inner side thereof;

a washer in which the bolt is fitted by passing through a center of the washer; and a knob which has a nut at a center thereof such that the bolt passes through and is fastened to the nut.

4. The coupling structure of a visor hinge for a headband according to claim 3, wherein the rotation body comprises:

a male portion in which an auxiliary stopper protrudes on an extended lever at one side of the male portion; and a female portion which passes through the protective mask to be fixedly coupled to the inner side thereof while being formed, at one side thereof, with a plurality of angle adjustment holes such that the auxiliary stopper is fitted in an associated one of the angle adjustment holes during rotation.

* * * * *